US006368483B1

(12) United States Patent
Ball et al.

(10) Patent No.: US 6,368,483 B1
(45) Date of Patent: Apr. 9, 2002

(54) ALUMINIUM WORKPIECE

(75) Inventors: Jonathan Ball, Allcester; Nigel Cleaton Davies, Oxon; Rodney Charles Jones, Daventry; Eric Barlow, Oxon, all of (GB)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/403,289

(22) PCT Filed: Apr. 24, 1998

(86) PCT No.: PCT/GB98/01196

§ 371 Date: Jan. 18, 2000

§ 102(e) Date: Jan. 18, 2000

(87) PCT Pub. No.: WO98/49377

PCT Pub. Date: Nov. 5, 1998

(30) Foreign Application Priority Data

Apr. 25, 1997 (EP) ..... 97302854

(51) Int. Cl.[7] ..... C25D 11/04

(52) U.S. Cl. ..... 205/106; 205/121; 205/129; 205/139

(58) Field of Search ..... 205/120, 121, 205/106, 129, 139; 428/621, 628, 632, 635, 640, 650, 654, 469, 472, 688, 689, 702

(56) References Cited

U.S. PATENT DOCUMENTS 4,066,816 A * 1/1978 Sheasby et al.
4,131,518 A * 12/1978 Fromsom
4,152,222 A * 5/1979 Sheasby et al.
4,177,299 A * 12/1979 Severus et al.
4,188,270 A * 2/1980 Katoaka
4,310,586 A * 1/1982 Sheasby et al.
4,414,077 A * 11/1983 Yoshida et al.
4,681,668 A * 7/1987 Davies et al.
5,167,793 A * 12/1992 Jozefowicz
5,250,173 A 10/1993 Jozefowicz
5,472,788 A * 12/1995 Benitez-Garriga
5,904,989 A * 5/1999 Hanggi et al.

FOREIGN PATENT DOCUMENTS

| | | |
|---|---|---|
| GB | 2012305 | 7/1979 |
| JP | 6033390 | 2/1985 |
| WO | WO9219795 | 11/1992 |

OTHER PUBLICATIONS

Wernick & Pinner, *The Surface Treatment Of Aluminium And Its Alloys,* (1987), No Month pp. 178, Identification No. XP002069322.

Abstract of Japanese Patent Publication No. 87–0093684, World Patent Index, Identification No. XP002038706 (Apr. 15, 1987).

Abstract of Japanese Patent Publication No. 60–033390, Patent Abstracts of Japan, (Feb. 20, 1985).

Wernick & Pinner, *The Surface Treatment Of Aluminium And Its Alloys,* (1987), No Month pp. 316–317, 356–357, 413, 820–821, Identification No. XP002038705.

* cited by examiner

*Primary Examiner*—Deborah Jones
*Assistant Examiner*—Jason Savage
(74) *Attorney, Agent, or Firm*—Cooper & Dunham, LLP

(57) ABSTRACT

An aluminum workpiece, e.g. sheet for containerstock, having an anodic oxide film whose thickness varies from location to location on the surface, whereby interference contrast effects are visible on the surface. Aluminum foil having on a surface thereof an unsealed anodic oxide film 5–1000 nm thick which provides a clean surface with fretting resistance. A method of anodizing thin aluminum foil is also described.

4 Claims, 1 Drawing Sheet

ALUMINIUM WORKPIECE

Figure 1:
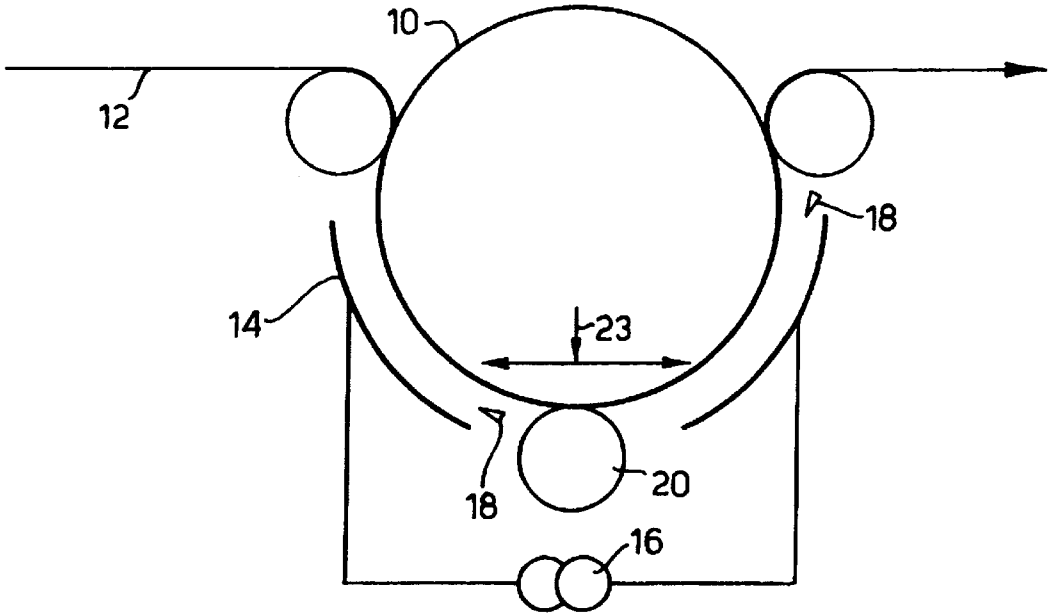

This invention concerns aluminium workpieces, particularly aluminium sheet, mainly thin sheet used for containerstock or as foil. Containers are often subjected to abrasion during transportation prior to filling.

Foil containers are frequently formed, stacked together and then transported to a separate site for filling. The process of transportation results in fretting between adjacent containers. Cleaning the foil stock and then coating the surface with an abrasion resistant coating can prevent fretting, but the economics of foil production require that any coating process be of low cost.

Cleaning of foil stock at high speed is difficult. Annealing alone does not give adequate cleaning, and chemical rinses are often too mild, i.e. they only degrease. Electrolytic processes are probably the only ones that can clean a foil surface in the short process times required.

Currently, foil for food use is sold as a commodity product mainly in the bare state or backed with paper or polymer as a laminate, sometimes with simple lacquer printing. Generally, printed or laminated products are suitable only for cold applications, e.g. sandwich wrap, while bare metal is also frequently employed in food ovens. Few coatings are available that on heating, do not at least partially discolour or act as a source of chemicals for migration into food. Pretreatments such as chromating, which could also colour the surface, tend not to be approved for direct food contact. However, premium foil producers wish to differentiate their product with a pleasing visual design without risking migration of foreign species into food.

The present invention addresses these problems. In one aspect the invention provides an aluminium workpiece having on a surface thereof an anodic oxide film, the thickness of the anodic oxide film being different at different predetermined locations on the surface, wherein optical interference colours are visible when the surface is viewed in white light with different colours visible at the said different predetermined locations on the surface, and wherein a metal deposit is not present within the aluminium oxide film.

A workpiece is a body of indeterminate size and shape. For example extrusions, both continuous extrusions and cut lengths, are workpieces. Formed units e.g. for architectural use or as vehicle panels are workpieces. Another example of a workpiece is a container. Sheet and plate, both in continuous form and in the form of cut pieces, are further examples of workpieces. As previously noted, the invention is mainly concerned with thin sheet of the type used for containerstock or as foil.

As discussed in more detail below, interference colour effects arise due to interference between light reflected from a metal/oxide interface at the bottom of the anodic oxide layer, and light reflected from the air/oxide interface at the top of the anodic oxide layer and/or from some semi-transparent reflective layer supported on or in the anodic oxide layer. Interference colour contrasts are generated when the thickness of the anodic oxide film is different at different predetermined locations on the surface.

The invention provides aluminium foil in the form of a continuous strip or of cut sheet at least 1 $m^2$ in area, and having on a surface thereof an unsealed anodic oxide film 5–1000 nm thick. The anodic oxide film gives an attractive finish that also imparts wear resistance and results in a clean finish.

Aluminium sheet has in the past been continuously anodised mainly for two purposes. In one application, continuous anodising is performed at low line speeds to make thick protective anodic oxide films for architectural use. Such films comprise a barrier layer and an overlying porous layer, and the pores are sealed prior to use. The second application is performed at higher line speeds to make thin pretreatment layers to promote the adhesion of organic coatings to the sheet. Such films are typically 100 nm or less thick and are made in phosphoric acid or a similar electrolyte having substantial dissolving power for aluminium oxide, so that the resulting film is extremely rough with pillars or whiskers which provide a keying effect and promote adhesion. The anodic oxide films carried by aluminium sheet of the present invention are quite different from either of these prior art structures.

In another aspect the invention provides a method of anodising aluminium foil, which method comprises passing the foil round at least one roll immersed in anodising electrolyte and facing a series of at least three pairs of electrodes with anodising current applied between the two electrodes of each pair.

In another aspect the invention provides a process for cleaning aluminium foil, which process comprises anodising the foil in the form of continuous strip or of cut sheet at least 1 $m^2$ in area so as to form on a surface thereof an unsealed anodic oxide film 5–1000 nm thick.

The word aluminium is herein used to cover the pure metal and alloys in which Al is a major component. The alloy may be for example in the 1000 or 3000 or 5000 or 6000 or 8000 series of the Aluminum Association Register. For example, AA 3003 and 8008 are often used for containerfoil, and AA 1100 and 1200 and 8006 are often used for foil.

Containerstock is thicker gauge foil often 80–150 $\mu$m or thicker that is formed into usually open containers for food or into food trays. The term aluminium foil is generally used to denote sheet below 150 $\mu$m thick. The invention is more particularly concerned with foil below 85 $\mu$m thick. Domestic cooking foil is typically 8–40, and usually 10–20, $\mu$m thick. Thin aluminium foil may be laminated onto a carrier such as plastic sheet for some applications such as packaging and food wrapping. The aluminium foil in this laminate is about 3–20 $\mu$m usually 5–20 $\mu$m thick.

Present on one or both surfaces of the sheet (but usually on one surface only) is an anodic oxide film. The film needs to be thick enough to provide fretting resistance, and should not be so thick that there is any risk of it spalling off when the foil is folded or flexed. A preferred range is 50–500 nm particularly 100–500 nm thick. Within this, films at least 125 nm thick have a major additional advantage that constructive interference colours are generated, between the metal/oxide interface on one side of the film and the oxide/air interface on the other and markedly enhance the appearance of the sheet. The pores are unsealed, i.e. they have not been formally sealed e.g. by being exposed to boiling water or steam nor to a proprietary cold sealing solution, although the pores may sometimes be found to be partly or wholly closed at their outer ends. Sealing would be impractical at the high line speeds required for economic operation.

Fretting resistance is usually an important requirement, especially in food containers. It is therefore generally preferred that such workpieces according to this invention have either one or both surfaces completely covered with an anodic oxide film. For household foil below about 40 $\mu$m thickness, fretting is less likely to be a problem. Foil or sheet according to the invention may have one surface (or even both surfaces) partly or preferably wholly covered with an anodic oxide film, which film may vary in thickness over different regions of the surface as discussed below.

The anodic oxide film could in principle be of the barrier layer type, grown in an electrolyte having no dissolving power for aluminium oxide. In such systems, film thickness is proportional to anodising voltage, and inconveniently high voltages might be needed to generate films of the required thickness. So preferably the anodic oxide film is of the type formed in an electrolyte having some dissolving power for aluminium oxide and comprises a barrier layer and an overlying porous layer. It is desired that the anodic oxide film reduces, rather than increases, any tendency for food to adhere to the aluminium sheet. With this in mind, the anodic oxide film should preferably have a rather smooth outer surface, and in particular the pores should not be substantially enlarged at their outer ends. This may best be achieved by anodising the aluminium foil in an electrolyte based on sulphuric acid rather than phosphoric acid. This results in an anodic oxide film containing sulphate ion. Oxalic acid may be used as well as or instead of sulphuric acid.

Aluminium foil is frequently made by pack rolling, which results in a product having one glossy and one matt surface. While it is possible to grow an anodic oxide film on either surface, a film grown on the glossy surface or more probably the matt surface may be capable of generating brighter interference colours. A condition for strong interference colours to be visible is that the intensity of the interfering reflections of the oxide/metal and air/oxide interfaces be comparable. Thus, anodic films on relatively pure and bright Al surfaces do not normally generate interesting colours. The oxide is so transparent and the metal so reflective that the ratio of reflectance at the air interface to that of the metal interface is only about 10:90 or worse. This generates negligible "fringe contrast" i.e. the differences in reflectance at the wavelength of peak reflectance (constructive interference) relative to that at the adjacent minimum, i.e. the reflectance spectrum has a few small amplitude wiggles superimposed on a high and relatively flat background. There are various ways of increasing interference colours intensity in anodic oxide films on aluminium metal:

1. Decrease the metal interface reflection. This may be done by ensuring that the metal surface is rough or matt, e.g. as a result of pack rolling or etching or rolling with rough rolls.
2. Modify the anodic oxide film so that it has some intrinsic absorptivity i.e. less light gets through the film to be reflected at the metal interface. The absorptivity of the anodic oxide film may depend on the composition of the Al alloy being anodised and/or of the anodising electrolyte.
3. Provide a semi-transparent reflective layer supported by the anodic oxide film, either within the pores or more preferably on the outside surface thereof. A semi-transparent reflective layer of this kind can be created, for example, by sputtering aluminium or another metal, or by electro deposition or electroless or immersion plating to create a metal or other pigment layer a few nm thick on or in the anodic film. Techniques for doing this are described in U.S. Pat. Nos. 5,112,449 and 5,218,472. Such semi-transparent reflective layers can enhance interference colour effects and can also create dichroic effects, i.e. a surface appears coloured differently when viewed from different angles. Such semi-transparent reflective layers can if desired be provided at predetermined locations on the surface, either by selective localised application or by selective localised removal of the (metallised) layer e.g. chemically or by abrasion.

Aluminium foil may carry a silicone or waxy organic film overlying the anodic oxide film or the semi transparent reflective layer. Such a film may assist feeding the film into machinery or may resist marking for example by fingerprints. Or the surface of the foil not carrying the anodic oxide film may be laminated e.g. to paper or polymer or coated with an organic lacquer. Preferably the aluminium foil consists of a metal substrate with one surface carrying an anodic oxide film and the other surface in a natural state (i.e. with a thin naturally occurring oxide film or a thinner anodic film) and no organic or other coating.

Aluminium sheet of this invention is in the form of cut sheet at least 1 $m^2$ or preferably at least 10 $m^2$ in size, or of continuous sheet of indeterminate length. While it is a simple matter to anodise a laboratory sample of aluminium sheet, anodising continuous thin sheet or foil is not simple, either technically or economically. Since the areas treated are of the order of hundreds of millions of square meters per year, a very high speed process is required, e.g. at least 100 m/min and preferably 300 m/min or even more preferably 500 m/min. The film needs to be grown to a thickness of at least 65 nm to get destructive interference and preferably to 125–500 nm for the more intense, and therefore more attractive, constructive interference bands.

Of course, an anodic oxide film of uniform thickness produces an interference effect which is monochromatic. Visually striking effects can be achieved by varying the anodic oxide film thickness over different predetermined locations on an aluminium workpiece. For example, variations in film thickness of at least 10 nm e.g. some tens of nm over regions spaced some mm or cm apart e.g. up to 10 cm are found to produce striking interference colour contrasts, and this is true even if individual interference colours are faint.

While it is desired that the whole of one surface of an aluminium sheet be covered by an anodic oxide film, it is by no means necessary that the whole of that film be of thickness suitable for generating interference effects. Some regions of the surface may be colourless, e.g. by being too thin or alternatively too thick to generate interference effects. Localised variation in anodic film thickness across the width of the sheet can be achieved by careful positioning of counter electrodes in an anodising electrolyte bath through which a continuous aluminium sheet is passed. Variation in anodic film thickness along the length of the sheet can be achieved by changing the total coulombic input along the length. With suitable semi conductor control of the power supply to the anodising bath, it is possible to make quite rapid changes to the voltage and obtain closely spaced bands of colour along the length of the sheet.

Longitudinal interference colours may be generated for example, by shaping or positioning a counterelectrode so that its distance from the foil varies across the width of the foil, or so that its length (in the direction of travel of the foil) varies over the width of the foil.

This can also be achieved by masking off portions of the counter electrode in the longitudinal direction, so that the current has to travel through correspondingly more electrolyte to some parts of the foil surface than to other parts. Where the differential film growth rate is dependent on the distance travelled through the electrolyte in these arrangements the visual banding produced is strongly dependent on the throwing power of the electrolyte, and hence its composition and temperature. It is clear that geometries that allow narrow electrode gaps will therefore produce the most variation in surface finish as a greater differential resistance can be created from the electrode to the aluminium surface. However, when designing these systems it should be borne in mind that using resistance increase is less energy efficient than increasing the length of the electrode over parts of the foil width.

Variation in film thickness and therefore colour in the transverse direction can be achieved by varying the voltage (and hence current density) applied across part or all of the strip, in a manner related to the velocity of the strip. This may be done by programming a semiconductor controller such as a thyristor. Combining the longitudinal and transverse methods of control allows step changes or smoothly varying stripes of colours, such as sine waves, to be formed down the length of the strip.

Where sharp changes in colour are required, it is possible to hold a rubber mask against the surface of the strip. The mask may be pattern cut to allow images or messages. The masking can be achieved by simply interleaving the strip with a non-conductive material such as a polymer. In this manner, colour changes can be achieved that are not in the same sequence as the normal rainbow spectrum.

The invention is concerned with relatively thick oxide films, and for a continuous high speed process requires quite high current densities to keep the electrolytic cell to an economic length. Foils for domestic use are often in the 10–15 $\mu$m gauge range of thickness and as such are quite resistive along their length. Power costs are a significant factor in such a process. However, to grow a film of a certain thickness requires a minimum charge density and so, for economy of operation, the voltage losses need to be kept to a minimum in order to minimise the power required. Economic cell design therefore demands that a short current path is essential.

To support such thin foils and prevent breakages a cylindrical cell geometry is preferred. In one embodiment the cylinder is also a contact roll. The centre portion of the roll needs to be conductive while the outer edges that are overlapped by the foil have to be non-conductive in order to prevent direct passage of the current from the counter electrode to the contact roll. At speeds in excess of 70 m/min arcing has been a problem in the past with contact rolls, and careful design to avoid this is necessary.

In another embodiment the cylinder is non-conductive. The foil is passed round at least one roll immersed in anodising electrolyte and facing a series of at least three pairs of electrodes with anodising currents applied between the two electrodes of each pair. In order to maintain a short current path within the foil, a small diameter squeegee roll can be used to electrically isolate counter electrodes of opposite phase. At the production speeds envisaged, the series of electrodes needs to have collectively a length, measured in the direction of travel of the aluminium foil, of 5–50 m, e.g. about 20 m. This is too long to be supplied through a single pair of electrodes. So a series of 3 to 10 pairs of electrodes is envisaged, typically about 5 pairs of electrodes. Each pair of electrodes may face a different cylinder round which the aluminium foil is led, and may be positioned in the same or different electrolyte baths.

Figure 2:
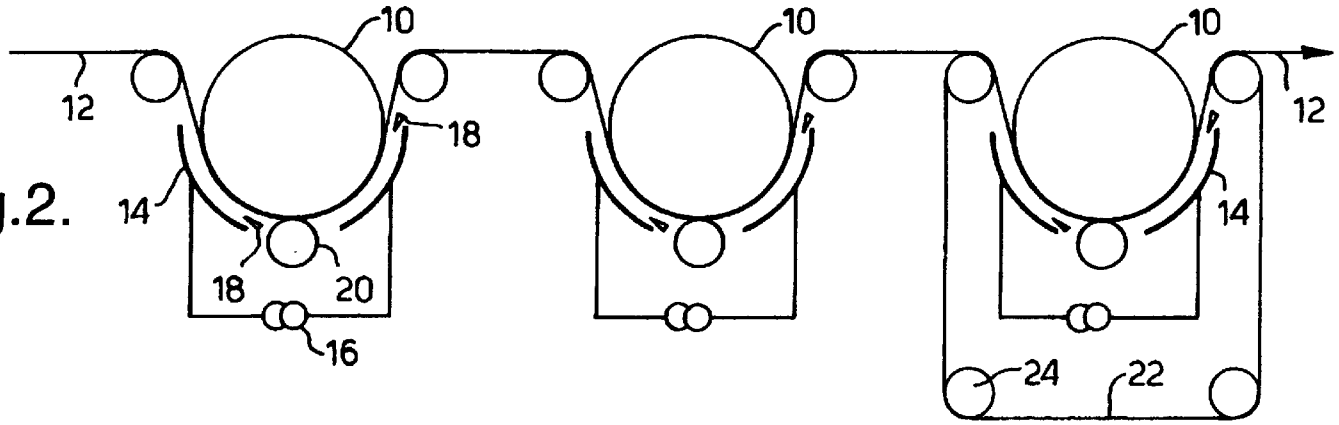

Reference is directed to the accompanying drawings, in which each of FIGS. 1 and 2 is a diagrammatic side view of equipment of the kind described in the previous paragraph.

FIG. 1 shows a cell for anodising foil comprising a support roll 10 round which a continuous coil of aluminium foil 12 is led. A pair of counter electrodes 14, facing the foil on the support roll, are connected to an AC power supply 16. Electrolyte injection points 18 provide electrolyte for electrical contact between the counter electrodes and the foil. A squeegee roll 20 is positioned between the counter electrodes to minimise bypass currents and ensure that current passes through the foil along a short current path 23.

FIG. 2 is a corresponding view of a multiple cell arrangement for maintaining low resistance. Foil 12 is led round a series of three support rolls 10 each provided with a pair of counter electrodes 14 connected to an AC power supply 16. The reference numerals in FIG. 2 are the same as in FIG. 1.

Also shown in connection with the third roll 10 is a continuous belt 22 of insulating material which is cycled round rolls 24, and which overlies the aluminium foil 12 where it faces the counter electrodes 14. Shaped apertures (not shown in the drawing) are provided in this belt 22 and can be used, by appropriate choice of anodising conditions, to generate correspondingly-shaped interference colour images on the aluminium foil.

An anodising cell may be operated in either the AC or DC mode. Any traditional electrolyte used for anodising can be used in principle, but as the interference colour is sharper when only two reflecting surfaces are provided, i.e. the metal/oxide interface and the oxide/air interface, the fewer and smaller the pores in the anodic film the better.

Anodising in an electrolyte having no dissolving power for aluminium oxide results in the formation of a barrier layer type film whose thickness is proportional to the anodising voltage and which is non-porous. When aluminium sheet is anodised in an electrolyte having some dissolving power for aluminium oxide, the resulting anodic oxide film comprises a thin barrier layer adjacent the metal interface and an overlying porous layer which may be regarded as consisting of an array of hexagonal cells with a pore at the centre of each cell. The diameter and spacing of the pores depends on the anodising voltage; when this is x volts the pore diameter is typically x nm and the pore spacing 2.5 x nm. The porosity of such a layer is thus about 7.3%. Because the anodising electrolyte is capable of chemically dissolving aluminium oxide, the pores are frequently larger than x nm due to chemical dissolution during anodising. This chemical dissolution effect is more apparent with phosphoric acid electrolytes than with sulphuric acid. In products according to the invention, the porosity of this layer of the anodic oxide film is preferably less than 25%; above this figure there is an increasing risk that foodstuffs and other undesired contaminants will adhere to the anodic oxide film.

The following operating parameters are provided as suggestions or indications, and substantial variation of one or all of them is likely to be possible or convenient. As noted, a preferred anodising electrolyte is based on sulphuric acid e.g. at a concentration of 5–30% particularly about 20%. A preferred electrolyte temperature is 30–90° C. for example about 50° C. A preferred anodising voltage (DC or rms AC) is 15–60 V, particularly about 40 V, though higher voltages are likely to be needed if it is desired to grow a barrier layer film. At the line speeds envisaged and to avoid need for electrolyte baths of excessive lengths, immersion times of 0.5–10 seconds, e.g. around 2.5 seconds are likely to be appropriate. A preferred current density may be 1–5 $KA/m^2$ e.g. about 4 $KA/m^2$. The charge density is a function of desired film thickness, and may be for example around 10 $KC/m^2$ based on a 100% efficient anodising.

Through improved cell design it is possible to anodise at high speed very thin gauge foil and grow films in the interference colour range of thickness. These impart a pleasant appearance across the full spectral range of colours to the surface by effectively only increasing the thickness of the oxide film on the metal.

There are also some additional advantages. Any metal fines loosely attached to the surface are removed and the oxidised surface is left more abrasion resistant, so that in wear situations, e.g. stacked container trays fretting in transit, the surface does not produce fines by abrasion. So far as domestic cooking foil is concerned, discoloration of food in contact with the foil is reduced. Furthermore, an anodic film is resistant to chemical attack in the pH range 3–9 so some additional corrosion resistance is imparted for food contact.

The invention is applicable to aluminium workpieces generally, including sheet, containerstock and foil products generally, including yoghurt tops, closures, lidstock etc. and particularly cooking foil for domestic use.

EXAMPLE 1

The following results address the issues of cleanliness and abrasion resistance. Anodic oxide film was grown on small samples of aluminium foil under laboratory conditions remote from those that would be used in a continuous anodising production line.

For quality control purposes foilstock is subjected to an actuality test that is an industry standard known as the Sutherland Rub Test (SRT). A piece of card is held on a weighted arm and this is then mechanically oscillated over the flat surface under test. The card is then inspected visually against standards and awarded a grade depending on the quantity of smut picked up. Grades A, B and C are acceptable while D and higher are judged to be too dirty. (B+ is half way between B and C). The interpretation of the test is open to debate but it does represent the actual conditions a foil surface may encounter.

First trials were done on 110 μm AA3105 foil in 10% phosphoric acid at 50° C. using AC power and an aluminium counter-electrode held 100 mm from the sample. The results are shown in Table 1 and demonstrate that in nearly all cases anodising raised the SRT from a D++ to an A.

Samples of 220 μm thick M8018 stock having different film thicknesses were anodised on a continuous line which applied AC power to the strip in the liquid contact manner and had 16 graphite pillar box counter electrodes with an inter-electrode gap of 50 mm. In this electrolyte, which has moderately good throwing power, it is common commercial practice to calculate the contact time from the distance between roll centres and the line speed, even though the current density will be higher when the material is in the electrode gap. The results are is shown in Table 2. SEM examination showed that scoring of the surface occurred even on the anodised surfaces when subjected to the SRT test, but that this could vary according to the conditions; the thicker films having the least damage. Table 3 shows results for 110 μm AA3105 that had been anodised in 20% phosphoric acid at 80° C. at 1 kA/m$^2$ to a film thickness of about 30 nm.

A number of samples were anodised in commercial trials. Three sulphuric acid anodised samples were produced and scored A, A and A+ and eight phosphoric acid anodised samples which all scored A. Again the starting stock scored a D. Some of these samples were later converted into containers and subjected to various tests. Those that had reasonable films, i.e. >30 nm, withstood in-transit abrasion testing.

TABLE 1

| ANODISING CONDITIONS | | APPROX. FILM | | SURFACE CLEANLINESS | |
|---|---|---|---|---|---|
| VOLTAGE (V) | TIME (sec) | THICKNESS (nm) | CURRENT DENSITY (kA/m$^2$) | SURFACE TREATMENT | RUB TEST GRADE |
| 40 | 10 | 300 | 3.0 | U | A |
| 40 | 3 | 100 | 3.0 | U | — |
| 40 | 3 | 100 | 3.0 | T | A |
| 20 | 10 | 130 | 1.9 | T | A |
| 20 | 3 | 40 | 1.9 | T | A+/B |
| CONTROL | | | | U | D++ |
| CONTROL | | | | T | D |

Samples anodised in $H_3PO_4$ (10%) @ 50° C.
U is untexturised
T is texturised

TABLE 2

EFFECT ON S.R.T. OF ELECTROLYTIC PROCESSING
1. SULPHURIC ACID ANODISED

| FILM THICKNESS (nm) | CURRENT DENSITY (kA/m$^2$) | POTENTIAL (V) | LINE SPEED (m/min) | SRT GRADE UNTEXTURISED | SRT GRADE TEXTURISED |
|---|---|---|---|---|---|
| AS ROLLED | — | | | C+ | D |
| 30 | 0.5 | 6 | 90 | A+ | A+ |
| 60 | 1.0 | 12.5 | 90 | A | A+ |
| 100 | 1.65 | 21 | 120 | A | |

Conditions:-
8018 alloy, 220 μm. 16% Sulphuric acid @ 87° C.
5 m between roll centres

TABLE 3

2. PHOSPHORIC ACID CLEANED

| SAMPLE CONDITION | SRT GRADE UNTEXTURISED | SRT GRADE TEXTURISED |
|---|---|---|
| AS ROLLED | D | C+ |
| 3 SEC. CLEAN | A+ | A+ |

Conditions:-
3105 alloy, 110 μm. 20% Phosphoric acid @ 80° C.

EXAMPLE 2

Three sheets of AA1AXXX alloy processed to give different surface roughnesses were anodised to a film thickness of 0.2 μm in 20% sulphuric acid at 50° C. using AC. AA1XXX counter-electrodes of similar size were held 50 mm from the workpiece, 1 kA/m$^2$, for 5s. The etched sample was electro-grained in a 1% nitric acid solution @ 40° C. in the liquid contact mode (i.e. Graphite-Al-Graphite) for 30s using graphite counter-electrodes with an Al-graphite gap of 15 mm. The voltage was 14V AC Positive charge density 90 coulombs/m$^2$.

TABLE 4

| Alloy | Surface Condition | Ra | Optical Appearance |
|---|---|---|---|
| | Bright Rolled side of Foil | 0.35–0.4 | Faint colours. Too smooth? |
| AA1050A | Sheet as rolled no etch | 0.5 | Bright colours |
| AA1050A | Sheet rolled and etched | 1.1 | No colours |

Ra measurement was made using a Perthen Optical Profilometer. While this instrument gives a general idea of the roughness of the surface, it does not provide a complete characterisation. Other features of the surface not revealed in this measure of roughness may also affect the brightness of the interference colours.

EXAMPLE 3

A sample of aluminium sheet was immersed in a 25% sulphuric acid electrolyte at 50° C. and anodised. The sheet was held such that the surface was a variable distance from a graphite counter-electrode and a DC voltage of 14V was applied for 13 seconds. An anodic film having a variable thickness was produced on the aluminium sheet as a result of the variable distance between and the counter-electrode. The current density was variable across the sample but the coulombic efficiency is almost 100% in these mild conditions. Interference colours were strongly visible on the surface of the sample and were related to the anodic oxide thickness as follows:

| Distance from Electrode (mm) | Film Thickness (nm) | Colour |
|---|---|---|
| 71 | 170 | Yellow |
| 60 | 200 | Red |
| 51 | 270 | Blue |
| 45 | 340 | Yellow |
| 38 | 410 | Red |
| 32 | 460 | Green |

The first three of these result from first order constructive interference between light reflected from the metal/oxide interface and light reflected from the oxide/air interface; and the last three show constructive second order interference. At film thicknesses below 170 nm, colours were faint or invisible. However, sputtering of a 5 nm Al layer on the oxide film would, in applicants' experience, have made differential interference colour effects visible at lower thicknesses down to 50 nm and below. The rainbow sequence of colour obtained greatly enhanced the appearance of each individual colour.

EXAMPLE 4

A pilot scale cylindrical cell was used similar to that shown in FIG. 1 except DC was employed. The counter anode and cathode were aluminium and lead respectively and were 0.68 m long. The foil was first subjected to cathodic cleaning and then anodised. The foil width was 150 mm. The line speed employed was 5 m/min and the inter-electrode gap 37 mm. The electrolyte was 16.5% sulphuric acid at 60° C. On this pilot scale equipment, the low speed attainable requires only a relatively low current density. Substantially higher current density would be utilised on faster production equipment. Anodic oxide film thicknesses were measured by an infra red technique and were in some cases checked by transmission electron microscopy. In some cases, interference colours were observed in the anodised product. Samples were metallised, by having a 5 nm Al metal layer sputtered on to the anodic oxide film. This had the effect of actual or potential colours in the simple anodised products. The results are set out in Table 5.

TABLE 5

| Test | Potential DC (V) | Current Setting (Amps) | Current Density ($A/m^2$) | Charge Density ($kC/m^2$) | Oxide Thickness (nm) | Foil Colour: Anodised only | Foil Colour: After Metallising |
|---|---|---|---|---|---|---|---|
| 1 | 2.5 | 10 | 70 | 0.57 | 10 | | light beige |
| 2 | 4 | 20 | 150 | 1.23 | 10 | | beige |
| 3 | 5 | 30 | 235 | 1.92 | 60 | | purple/brown |
| 4 | 6.2 | 40 | 317 | 2.59 | 100 | blue? | blue |
| 5 | 12.4 | 124 | 1048 | 8.55 | 320 | green | yellow/green |
| 6 | 14 | 150 | 1277 | 10.42 | 450 | red | pink/purple/green |
| 7 | 7.5 | 30 | 265 | 2.16 | 60 | | blue |
| 8 | 16.4 | 150 | 1571 | 12.83 | 450 | red/green | pink |

EXAMPLE 5

Samples of AA8006 foil 15 μm thick and samples of AA1050A lithographic sheet were provided, each having a surface area of 0.036 $m^2$. Each sample was immersed in sulphuric acid facing a single bar graphite counter electrode 13×15 mm held 100 mm from the sample and subjected to AC anodising for 5 seconds. Because of the good throwing power of this electrolyte and the large electrode gap, the front surface of the panel, which took most of the charge, was fairly uniformly anodised and contrasting colours were not produced. However, where the distance travelled by the current was much longer to the reverse side of the panel (140–190 mm) large colour changes were observed.

The anodising conditions and the visual appearance of the samples are reported in Table 6.

Each foil sample (F) had been produced by pack rolling and had a front (glossy) surface and a back (matt) surface. It may be noted that the interference colour contrast effects were somewhat more noticeable on the matt back surface of the foil sample. The litho sheet sample (L) also had distinct front and back surfaces.

TABLE 6

| F or L | Electrolyte Temp (° C.) | Nominal Volts (V) | Rms Current (A) | Charge Density ($kC/m^2$) | Visual Appearance: Front | Visual Appearance: Back |
|---|---|---|---|---|---|---|
| F | 50 | 30 | 138 | 19 | | Good |
| F | 50 | 30 | 131 | 18 | Good | |
| F | 60 | 30 | 175 | 24 | | Good |
| F | 60 | 30 | 169 | 23 | Medium | |
| L | 60 | 30 | 145 | 20 | Medium | Good |
| L | 60 | 35 | 223 | 31 | Medium | Good |
| L | 60 | 30 | 142 | 20 | Good | Medium |
| L | 60 | 35 | 221 | 31 | Good | Medium |

EXAMPLE 6

AA8006 foil 15 μm thick was anodised as in Example 4 using the conditions set out in Table 7. Matt side or bright side was anodised. A semi reflective 5 nm thick layer of aluminium was sputtered over the anodic film using batch sputtering equipment.

In a second test, anodising was carried out as above. About 150 m of foil from each test was then coated with semi reflective layer of stainless steel about 10 nm thick, using commercial continuous sputtering equipment (Table 8).

Before coating with a sputtered layer, samples from each test were examined for colour. A range of colours was produced, depending on the anodic film thickness. When examined individually, the colours appeared faint. The appearance of the colours was greatly enhanced when dissimilar samples were held adjacent to each other.

After coating with sputtered layer, the colour of each sample, as expected, was more striking. But again, the colours were enhanced when dissimilar samples were held adjacent to one another.

Both sets of the tests demonstrate the unexpected enhancement of perceived colour obtained by a predetermined variation in thickness of anodic film.

Sputtering on a commercial line after continuous anodising demonstrates the commercial applicability of this invention.

TABLE 7

| Code | Foil Stock | Foil Finish Anodised | Electro-lyte Temp. (° C.) | Poten-tial (V) | Current Set-ting (Amps) | Current After Leakage (Amps) | Density (A/m²) | Charge Density (kC/m²) | FT-IR Oxide Thickness (nm) | Colour After Metallising 0° | Colour After Metallising 90° | Colour Measurement L | Colour Measurement A | Colour Measurement b |
|---|---|---|---|---|---|---|---|---|---|---|---|---|---|---|
| 21 | AA8006 | Bright | 50 | 8.6 | 40 | 31.4 | 295 | 2.41 | 159 | purple/yellow | beige/yellow | 47 | 15 | 7 |
| 22 | soft | | | 12.1 | 70 | 57.9 | 544 | 4.45 | 282 | l. yellow | green | 79 | −1 | 15 |
| 23 | 15 μm | | | 14.5 | 100 | 85.5 | 803 | 6.57 | 359 | violet | l. gold | 57 | 35 | −36 |
| 24 | | | | 15.6 | 120 | 104.4 | 980 | 8.02 | 381 | green/yellow | purple | 74 | −30 | 20 |
| 25 | | | | 16.9 | 150 | 133.1 | 1250 | 10.22 | 395 | green/pink | yellow/pink | 56 | 6 | −26 |
| 26 | | | 60 | 14.6 | 150 | 135.4 | 1271 | 10.40 | 389 | green/purple | yellow/pink | 55 | −10 | −23 |
| 27 | | | | 12.7 | 120 | 107.3 | 1008 | 8.24 | — | | No Sample | | | |
| 28 | | | | 11.4 | 100 | 88.6 | 832 | 6.80 | 253 | r. blue | pink/purple | 42 | 23 | −62 |
| 29 | | | | 8.7 | 70 | 61.3 | 578 | 4.71 | 263 | yellow | green | 81 | −11 | 33 |
| 30 | | | | 6.3 | 40 | 33.7 | 316 | 2.59 | 163 | blue | pruple | 53 | 1 | −32 |
| 31 | | | 75 | 3.3 | 40 | 36.7 | 345 | 2.82 | 98 | blue | purple | 34 | 9 | −29 |
| 32 | | | | 6 | 70 | 64 | 601 | 4.91 | 261 | gold | green | 70 | 8 | 62 |
| 33 | | | | 7.8 | 100 | 92.2 | 866 | 7.08 | 323 | r. blue | purple | 51 | 4 | −51 |
| 34 | | | | 9.1 | 120 | 110.9 | 1041 | 8.52 | 354 | green/yellow | purple/green | 76 | −22 | 55 |
| 35 | | | | 10.4 | 150 | 139.6 | 1311 | 10.72 | 376 | purple | yellow/pink | 48 | 16 | −35 |
| 36 | | Matt | 60 | 13.8 | 150 | 136.2 | 1279 | 10.46 | 345 | pink/green | pink/yellow | 61 | 25 | −35 |
| 37 | | | | 12 | 120 | 108 | 1014 | 8.29 | 351 | yellow/green | green/blue | 86 | −34 | 58 |
| 38 | | | | 10.9 | 100 | 89.1 | 837 | 6.84 | 318 | r. blue | purple/pink | 58 | 1 | −57 |
| 39 | | | | 8.5 | 70 | 61.5 | 577 | 4.72 | 248 | yellow | yellow/green | 92 | −11 | 33 |
| 40 | | | | 5.7 | 40 | 34.3 | 322 | 2.63 | 128 | brown/purple | brown/purple | 40 | 12 | 22 |

TABLE 8

| Code | Foil Stock | Foil Finish Anodised | Electrolyte Temp. (° C.) | Potential (V) | Current Setting (Amps) | Current After Leakage (Amps) | Density (A/m²) | Charge Density (kC/m²) | FT-IR Oxide Thickness (nm) | Colour After Metallising 0° | Colour After Metallising 90° | Colour Measurement L | Colour Measurement A | Colour Measurement b |
|---|---|---|---|---|---|---|---|---|---|---|---|---|---|---|
| 41 | AA8006 | Bright | 71 | 7.2 | 70 | 62.8 | 590 | 4.82 | | | | | | |
| 42 | soft | Side | 72 | 9.1 | 100 | 90.9 | 854 | 6.98 | | | | | | |
| 43 | 15 μm | | 71 | 10.4 | 120 | 109.6 | 1029 | 8.42 | | | | | | |
| 44 | gauge | | 73–75 | 11.6 | 150 | 138.4 | 1300 | 10.63 | | | | | | |
| 45 | | | 60 | 14.4 | 150 | 135.6 | 1273 | 10.41 | 320 | pink/green | | 92.1 | −6.2 | 1.2 |
| 46 | | | 60 | 13.2 | 120 | 106.8 | 1003 | 8.20 | 280 | green/yellow | | 93.2 | -0.1 | 3.7 |

What is claimed is:

1. A continuous high speed process of anodizing an aluminum workpiece wherein the thickness of the oxide film produced is different at predetermined regions of,the workpiece surface, creating optical interference colors which are visible when the surface is viewed in white light, by contacting the said surface with electrolyte under conditions where the total coulombic input varies to directly govern the anodic film thickness produced in said predetermined regions.

2. The process of claim 1, wherein the said oxide film thickness falls within the range of 5 to 1000 nm.

3. The process of claim 1, wherein the said oxide film thickness falls within the range of 50 to 500 nm.

4. The process of claim 1, wherein a semi-transparent reflective layer is supported by the oxide film and enhances the optical interference colors.

* * * * *